US010369822B2

(12) United States Patent
Yamamoto et al.

(10) Patent No.: US 10,369,822 B2
(45) Date of Patent: Aug. 6, 2019

(54) PRINTER

(71) Applicant: Roland DG Corporation, Hamamatsu-shi, Shizuoka (JP)

(72) Inventors: Shinya Yamamoto, Hamamatsu (JP); Masakazu Igarashi, Hamamatsu (JP); Kiyomasa Imaizumi, Hamamatsu (JP); Takeshi Nakanishi, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 13 days.

(21) Appl. No.: 15/592,230

(22) Filed: May 11, 2017

(65) Prior Publication Data

US 2017/0326893 A1 Nov. 16, 2017

(30) Foreign Application Priority Data

May 12, 2016 (JP) ..... 2016-096038

(51) Int. Cl.

| | |
|---|---|
| ***B41J 19/20*** | (2006.01) |
| ***B41J 25/00*** | (2006.01) |
| ***B41J 29/38*** | (2006.01) |
| ***B41J 11/70*** | (2006.01) |
| ***B26F 1/38*** | (2006.01) |

(52) U.S. Cl.

CPC ..... *B41J 25/006* (2013.01); *B26F 1/3806* (2013.01); *B41J 11/70* (2013.01); *B41J 19/202* (2013.01); *B41J 19/205* (2013.01); *B41J 29/38* (2013.01)

(58) Field of Classification Search

CPC ..... B41J 11/66; B41J 11/663; B41J 11/666; B41J 11/68; B41J 11/70; B41J 11/706; B41J 29/38; B41J 29/387; B41J 2029/3932; B41J 19/205; B41J 19/202; B41J 19/207

See application file for complete search history.

(56) References Cited

U.S. PATENT DOCUMENTS

| | | | | |
|---|---|---|---|---|
| 5,245,359 | A * | 9/1993 | Ito | B41J 29/38 318/685 |
| 2013/0250013 | A1* | 9/2013 | Koichi | B41J 2/1752 347/86 |
| 2013/0278663 | A1* | 10/2013 | Sugimoto | B41J 19/205 347/14 |
| 2014/0146108 | A1 | 5/2014 | Ebihara | |
| 2015/0273893 | A1* | 10/2015 | Kudo | B41J 11/663 347/16 |
| 2017/0106655 | A1* | 4/2017 | Moriwaki | B41J 2/0451 |

FOREIGN PATENT DOCUMENTS

| | | | |
|---|---|---|---|
| JP | 2014-104634 | A | 6/2014 |

* cited by examiner

*Primary Examiner* — Scott A Richmond
(74) *Attorney, Agent, or Firm* — Keating & Bennett, LLP

(57) ABSTRACT

A printer includes a motor power supply line connecting a carriage motor with a power source, a sensor power supply line connecting a rotary encoder with the power source, a circuit breaker provided on the motor power supply line and interrupting electrical power if a cover sensor detects that a front cover is open and permit connection if the cover sensor detects that the front cover is closed, and a controller controlling the carriage motor and a recording head based on a position of a carriage detected by the rotary encoder.

6 Claims, 7 Drawing Sheets

PRINTER

CROSS REFERENCE TO RELATED APPLICATIONS

This application claims the benefit of priority to Japanese Patent Application No. 2016-096038 filed on May 12, 2016. The entire contents of this application are hereby incorporated herein by reference.

BACKGROUND OF THE INVENTION

1. Field of the Invention

The present invention relates to printers including an openable/closable cover.

2. Description of the Related Art

A conventionally known printer includes a carriage provided in a casing so to be movable along a main scanning direction, a recording head mounted to the carriage, a carriage motor for moving the carriage, and a cover attached openably and closably to the casing. As disclosed in JP 2014-104634 A, for example, the printer stops electrical power supply to the carriage motor when the cover is opened while the carriage is in motion. With such a printer, when the user opens the cover while the carriage is in motion, the carriage automatically stops. This prevents the user from inadvertently touching the carriage in motion.

The printer is equipped with a position sensor for detecting the position of the carriage, and a controller for controlling movement of the carriage and an operation of the recording head based on the position of the carriage that is detected by the position sensor. The conventional printer, which stops electrical power supply to the carriage motor when the cover is opened while the carriage is in motion, also stops detection of the position of the carriage at the same time as the stopping of the electrical power supply. Then, the controller recognizes the position of the carriage at the time when the electrical power supply is stopped (the position is hereinafter referred to as an electrical power supply stop position) as the position of the carriage at the time when printing is stopped. Thereafter, when the cover is closed, the controller restarts controlling the position of the carriage under the assumption that the electrical power supply stop position is the current position of the carriage.

However, even when electrical power supply to the carriage motor is stopped, the carriage does not always stop at the same time as the stopping of the electrical power supply. It is sometimes the case that even after the electrical power supply is stopped, the carriage may sometimes keep moving slightly due to inertial effects. Such a tendency is particularly noticeable with large-sized printers, in which the carriage and the recording head have relatively heavy weight and high moving speed. A printer equipped with a recording head and a cutting head is well known. With such a printer, it is sometimes the case that the carriage moves, not just the recording head, but both the recording head and the cutting head during printing. In such a case, the foregoing tendency is more noticeable because the overall weight of the carriage, the recording head, and the cutting head is especially great.

However, if the carriage continues to move due to inertial effects after the electrical power supply is stopped, the position at which the carriage stops moving will be different from the position at which the electrical power supply has been stopped. This causes a discrepancy between the position ascertained by the controller and the actual position of the carriage. When the user closes the cover thereafter, the controller restarts printing with the position of the carriage being misrecognized. As a consequence, a problem with the above-described printer has been that the printer cannot produce a desirable printing result once the cover is opened during printing, even if the cover is closed again and printing is restarted. When the cover is opened during printing, it is necessary to restart printing all over again in order to obtain a desirable printing result. This causes the problem of longer printing time.

The printer equipped with a recording head and a cutting head encounters the same problem when the cover is opened in the middle of cutting as well as when the cover is opened during printing. That is, a desirable cutting result cannot be obtained once the cover is opened in the middle of cutting and movement of the carriage is stopped, even if cutting is restarted by closing the cover thereafter.

SUMMARY OF THE INVENTION

Preferred embodiments of the present invention enable a printer in which the carriage automatically stops when the cover is opened during printing to restart printing in a more desirable manner after closing the cover than with conventional printers.

A printer according to a preferred embodiment of the present invention includes a casing; a guide rail disposed in the casing; a carriage engaged with the guide rail; a carriage motor coupled to the carriage and causing the carriage to move along the guide rail; a recording head provided on the carriage so as to move with the carriage; an openable/closable cover fitted to the casing; a cover sensor detecting whether the front cover is open or closed; a position sensor detecting a position of the carriage; a motor power supply line connecting the carriage motor with a power source; a sensor power supply line connecting the position sensor with the power source; a circuit breaker provided on the motor power supply line to open if the cover sensor detects that the cover is open; and a controller communicatively connected to the position sensor, the carriage motor, and the recording head, and controlling the carriage motor and the recording head based on the position of the carriage detected by the position sensor.

A preferred embodiment of the present invention makes it possible to provide a printer that enables the carriage to automatically stop when the cover is opened during printing and that enables the printer to restart printing in a more desirable manner after the cover is closed than conventional printers.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinbelow, printers according to preferred embodiments of the present invention will be described with reference to the drawings. The preferred embodiments described herein are not intended to limit the present invention. The features and components that exhibit the same effects are denoted by the same reference symbols, and repetitive description thereof may be omitted as appropriate.

First Preferred Embodiment

Figure 1:
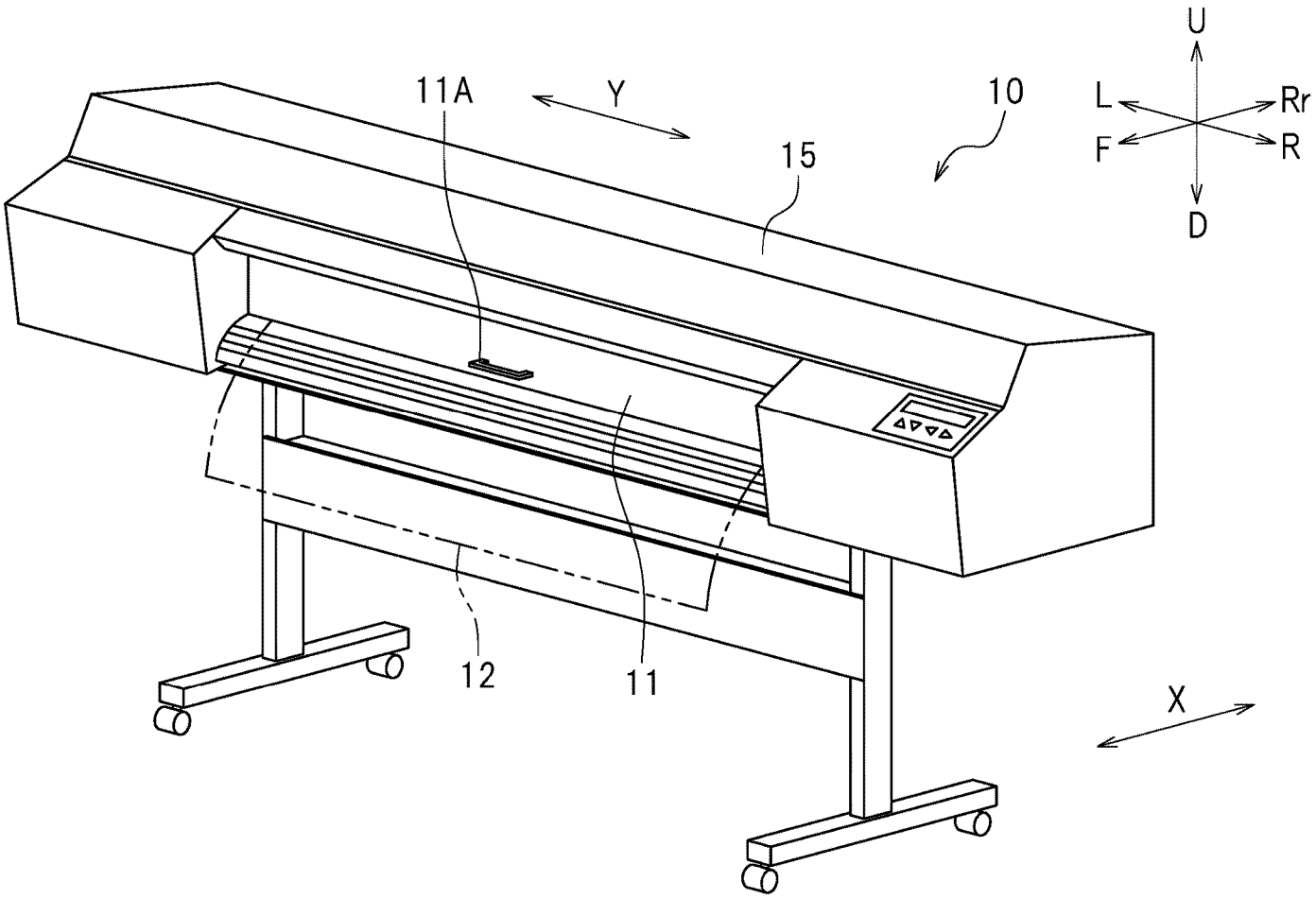
FIG. 1 is a perspective view illustrating a printer according to a preferred embodiment of the present invention.

FIG. 1 is a perspective view illustrating a printer 10 according to the present preferred embodiment. As illustrated in FIG. 1, the printer 10 performs printing on a recording medium 12. The recording medium 12 may be, for example, recording paper. The recording medium 12 is, however, not limited to the recording paper. The recording medium 12 may be sheet-shaped media other than the recording paper. The recording medium 12 may be a resin sheet, for example. The recording medium 12 may or may not have flexibility. The recording medium 12 may be a plate made of metal, for example.

In the following description, the terms "left," "right," "up," and "down" respectively refer to "left," "right," "up," and "down" as defined based on the perspective of the user facing the printer 10. A direction toward the user relative to the printer 10 is defined as "frontward," and a direction away from the user relative to the printer 10 is defined as "rearward." Reference characters F, Rr, L, R, U, and Din the drawings represent front, rear, left, right, up, and down, respectively. A later-described carriage 13 (see FIG. 2) is capable of moving leftward and rightward. The recording medium 12 is capable of being transferred frontward and rearward. In the present description, a direction in which the carriage 13 travels is referred to as a "main scanning direction", and a direction in which the recording medium 12 is transferred is referred to as a "sub-scanning direction". In the drawings, reference character Y represents the main scanning direction, and reference character X represents the sub-scanning direction. Herein, the main scanning direction corresponds to a left-right/right-left direction, i.e., the lateral axis, and the sub-scanning direction corresponds to a front-rear/rear-front direction, i.e., the fore-and-aft axis. The main scanning direction corresponds to a widthwise or lateral axis of the recording medium 12, and the sub-scanning direction corresponds to a longitudinal axis of the recording medium 12. The main scanning direction and the sub-scanning direction are perpendicular or substantially perpendicular to each other. It should be noted, however, that the main scanning direction and the sub-scanning direction are not particularly limited thereto and may be determined as appropriate, for example, depending on the configuration of the printer 10.

Figure 2:
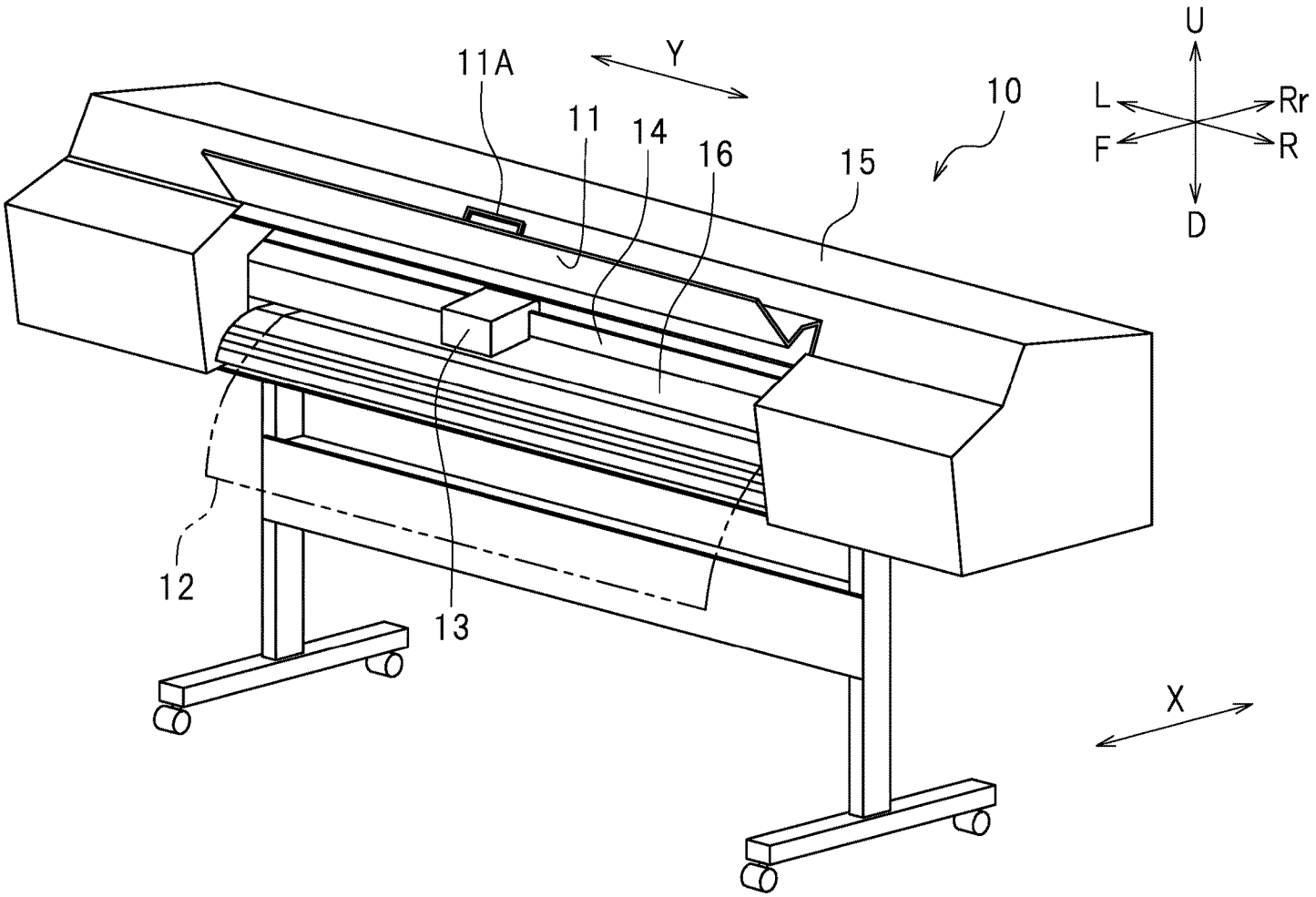
FIG. 2 is a perspective view illustrating the printer with a front cover being opened.

The printer 10 includes a casing 15 and an openable/closable front cover 11 that is fitted to the casing 15. The front cover 11 is provided with a handle 11A. FIG. 1 illustrates the state in which the front cover 11 is closed, and FIG. 2 illustrates the state in which the front cover 11 is open. As illustrated in FIG. 2, the printer 10 includes a platen 16 that supports the recording medium 12. A guide rail 14 is disposed above the platen 16. Note that the term "above" herein is not limited to meaning "directly above" but is intended to include "obliquely above". The guide rail 14 extends in a main scanning direction. A carriage 13 is fitted to the guide rail 14. Note that although the carriage 13 is shown with a rectangular parallelepiped shape in FIG. 2, the specific shape of the carriage 13 is not limited in any way. Various types of conventionally known carriages may be suitably used therefor.

Figure 3:
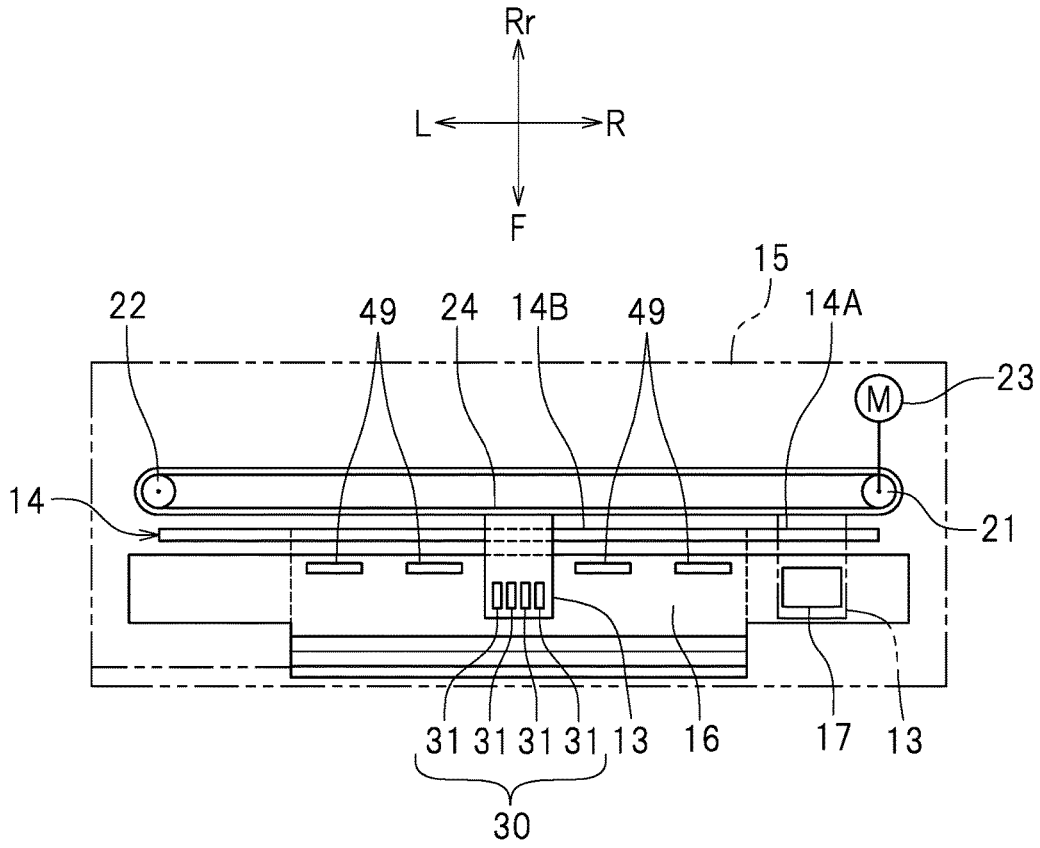
FIG. 3 is a plan view schematically illustrating main elements inside a casing of the printer according to a first preferred embodiment of the present invention.

FIG. 3 is a plan view schematically illustrating main elements inside the casing 15 of the printer 10. As illustrated in FIG. 3, a recording head 30 is mounted on the carriage 13. Herein, the recording head 30 preferably includes four inkjet heads 31, for example. It should be noted, however, that the number of the inkjet heads 31 is not limited in any way. In addition, the type of recording performed by the recording head 30 is not limited to the inkjet type. The recording head 30 is not limited to the one that is equipped with the inkjet heads 31.

Figure 4:
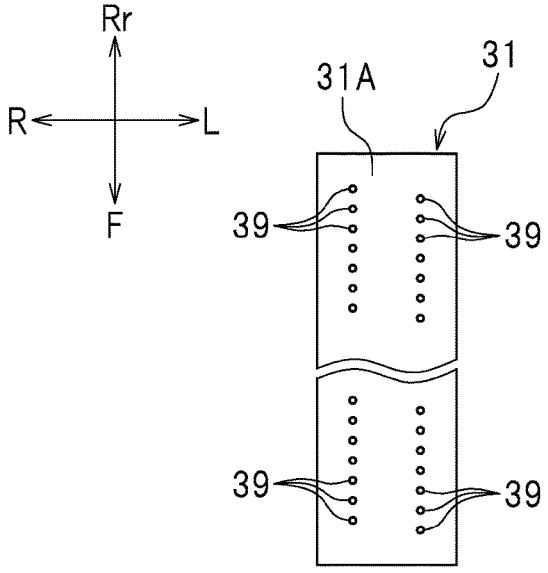
FIG. 4 is a view illustrating a back side of an inkjet head.

As illustrated in FIG. 4, a plurality of nozzles 39 arrayed along the sub-scanning direction are provided in a bottom surface 31A of the inkjet head 31. Herein, two columns of nozzle arrays including a plurality of nozzles 39 lined up along the sub-scanning direction preferably are provided in the bottom surface 31A of the inkjet head 31. The number and arrangement of the nozzles 39 are, however, not limited in any way.

As illustrated in FIG. 3, a drive pulley 21 is disposed to the right of the platen 16, and a driven pulley 22 is disposed to the left of the platen 16. The drive pulley 21 is connected to a carriage motor 23. The drive pulley 21 is driven and rotated by the carriage motor 23. A belt 24 is wrapped around the drive pulley 21 and the driven pulley 22. The carriage 13 is secured to the belt 24. Driven by the carriage motor 23, the drive pulley 21 rotates, and the belt 24 travels accordingly. As a result, the carriage 13 moves leftward or rightward while being guided by the guide rail 14.

A cap 17 is disposed closer to one end (the right end in the present preferred embodiment) of the guide rail 14 than the platen 16. The cap 17 covers the nozzles 39 of the inkjet head 31 by being fitted onto the recording head 30. Covering the nozzles 39 with the cap 17 prevents the ink inside the nozzles 39 from drying out.

The guide rail 14 includes a print area 14B positioned above the platen 16 and a home position area 14A positioned above the cap 17. Note that the term "above" here is not limited to meaning "directly above" but is intended to include "obliquely above". In the present preferred embodiment, the print area 14B is disposed rearward and obliquely upward of the platen 16, and the home position area 14A is disposed rearward and obliquely upward of the cap 17. The print area 14B is a portion that engages with the carriage 13 when the inkjet head 31 of the recording head 30 ejects ink toward the recording medium 12. The home position area 14A is a portion that engages with the carriage 13 when the cap 17 is fitted onto the recording head 30.

The platen 16 is provided with feed rollers 49. The feed rollers 49 are buried in the platen 16 so that a portion thereof is exposed from the platen 16. The feed rollers 49 are coupled to a feed motor, which is not shown in the drawings. The feed rollers 49 are driven by the feed motor so as to rotate. Pinch rollers, which are not shown in the drawings, are disposed above the feed rollers 49. The pinch rollers are capable of approaching toward and moving away from the feed rollers 49. Bringing the pinch rollers closer to the feed rollers 49 with the recording medium 12 being placed on the platen 16 causes the recording medium 12 to be pinched between the pinch rollers and the feed rollers 49. When the feed motor is driven with the recording medium 12 being pinched between the pinch rollers and the feed rollers 49, the recording medium 12 is delivered frontward or rearward by the feed rollers 49.

Figure 5:
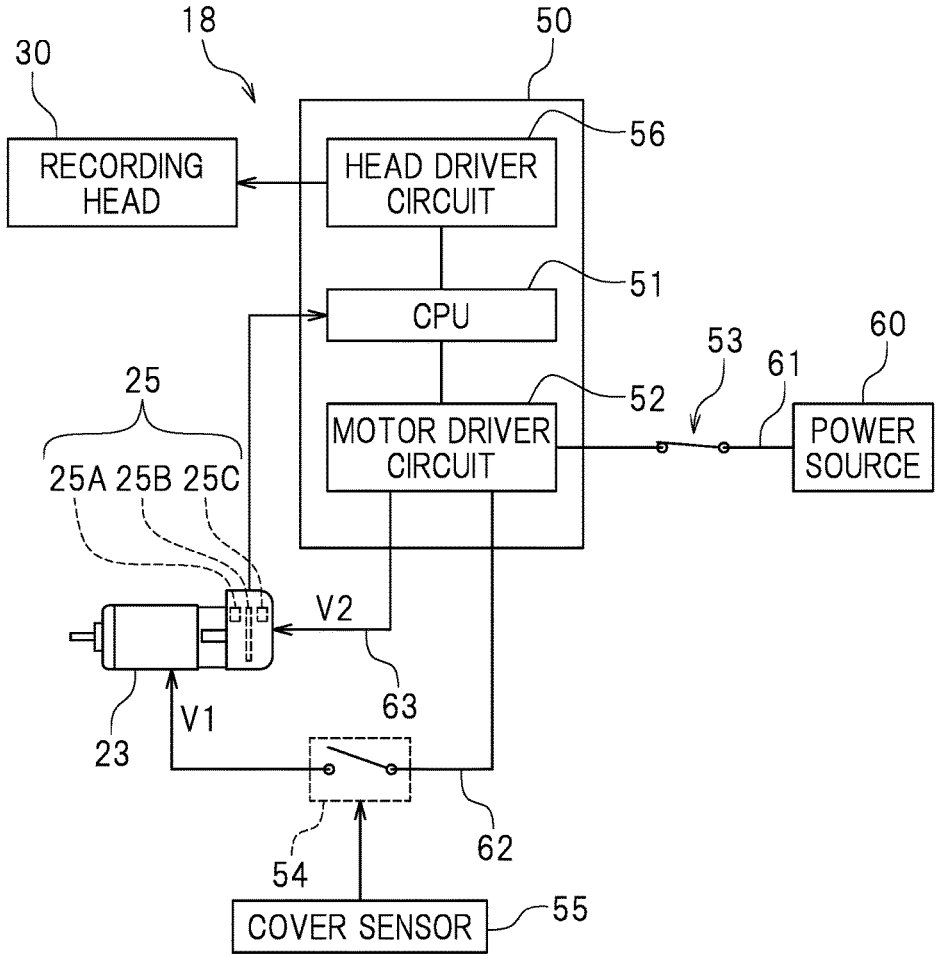
FIG. 5 is a block diagram illustrating a control system of the printer.

FIG. 5 is a block diagram illustrating a control system of the printer 10. The printer 10 is provided with an electric circuit 18 as shown in FIG. 5. The printer 10 includes a controller 50. The controller 50 includes a CPU 51, a motor driver circuit 52, and a head driver circuit 56.

The carriage motor 23 is a motor that is feedback controlled by the controller 50, and it is what is called a servomotor. The carriage motor 23 is provided with a rotary encoder 25. Although the rotary encoder 25 is not limited to any particular type, the rotary encoder 25 herein preferably is a photoelectric rotary encoder, for example. The rotary encoder 25 includes a light emitting element 25A, a photodetector element 25C, and a grating disc 25B disposed between the light emitting element 25A and the photodetector element 25C and provided with a plurality of slits formed therein. The grating disc 25B is coupled to a motor shaft (not shown) of the carriage motor 23. The rotary encoder 25 detects the rotational position of the carriage motor 23. As mentioned above, the carriage motor 23 and the carriage 13 are coupled to each other via the drive pulley 21 and the belt 24. The drive pulley 13 is driven by the carriage motor 23, so that it moves along the main scanning direction. When the rotational position of the carriage motor 23 is determined, the position of the carriage 13 is uniquely determined accordingly. Thus, it is possible to detect the position of the carriage 13 based on the rotational position of the carriage motor 23. In the present preferred embodiment, the rotary encoder 25 defines and functions as a position sensor to detect the position of the carriage 13.

The motor driver circuit 52 is connected to a power source 60 via a power supply line 61. The power supply line 61 is provided with a main switch 53. The motor driver circuit 52 and the carriage motor 23 are connected to each other by a power supply line 62. The motor driver circuit 52 and the rotary encoder 25 are connected to each other by a power supply line 63. The power supply line 61, the motor driver circuit 52, and the power supply line 62 together define a motor power supply line that connects the carriage motor 23 with the power source 60. The power supply line 61, the motor driver circuit 52, and the power supply line 63 together define a sensor power supply line that connects the rotary encoder 25 with the power source 60. In the present preferred embodiment, the same single power source 60 supplies electric power to both the carriage motor 23 and the rotary encoder 25. However, it is also possible to provide a power source to supply electric power to the carriage motor 23 and another power source to supply electric power to the rotary encoder 25.

The CPU 51 is communicatively connected to the rotary encoder 25, the motor driver circuit 52, and the head driver circuit 56. The CPU 51 is capable of identifying the position of the carriage 13 based on a signal from the rotary encoder 25. The CPU 51 controls the carriage motor 23 based on the position of the carriage 13. In other words, the CPU 51 controls movements of the carriage 13 based on the detected position of the carriage 13. The CPU 51 also controls ink ejection of the recording head 30 based on the detected position of the carriage 30. Although not shown in the drawings, the controller 50 also includes a motor driver circuit connected to the previously mentioned feed motor. The CPU 51 is communicatively connected to the motor driver circuit for the feed motor so that it can control the feed motor.

The power supply line 62 is provided with a circuit breaker 54, which defines and functions as an interlock mechanism. The printer 10 includes a cover sensor 55 that detects whether the front cover 11 is open or closed. The configuration of the cover sensor 55 is not limited in any way, and any conventionally known type of sensor may be used therefor. The circuit breaker 54 is communicatively connected to the cover sensor 55. When the cover sensor 55 detects that the front cover 11 is open, the circuit breaker 54 opens, so that electrical power supply to the carriage motor 23 is stopped. When the cover sensor 55 detects that the front cover 11 is open, the circuit breaker 54 interrupts the connection between the power source 60 and the carriage motor 23. In other words, the circuit breaker 54 interrupts the motor power supply line. When the cover sensor 55 detects that the front cover 11 is closed, the circuit breaker 54 closes, so that electrical power is able to be supplied to the carriage motor 23. When the cover sensor 55 detects that the front cover 11 is closed, the circuit breaker 54 allows the power source 60 and the carriage motor 23 to connect with each other. In other words, the circuit breaker 54 permits connection of the motor power supply line.

In the present preferred embodiment, when the front cover 11 is opened, the cover sensor 55 is turned ON, whereas when the front cover 11 is closed, the cover sensor 55 is turned OFF. The circuit breaker 54 opens when the cover sensor 55 is turned ON and closes when the cover sensor 55 is turned OFF. It is also possible, however, that the cover sensor 55 may be turned OFF when the front cover 11 is opened and turned ON when the front cover 11 is closed. In this case, the circuit breaker 54 preferably opens when the cover sensor 55 is turned OFF and closes when the cover sensor 55 is turned ON.

The motor driver circuit 52 applies a first voltage V1 to the carriage motor 23 and applies a second voltage V2 to the rotary encoder 25. The motor power supply line applies the first voltage V1 to the carriage motor 23, and the sensor power supply line applies the second voltage V2 to the rotary encoder 25. The carriage motor 23 is operated when a voltage equal to or higher than a predetermined minimum operating voltage is applied thereto. Note that herein, the phrase "the carriage motor 23 is operated" indicates that the carriage motor 23 is operated to such an extent that the carriage motor 23 is able to move the carriage 13 along the main scanning direction. The first voltage V1 preferably is set to be equal to or higher than the minimum operating voltage, and the second voltage V2 preferably is set to be lower than the minimum operating voltage. Accordingly, the carriage motor 23 is not operated even when the second voltage V2 is applied thereto. On the other hand, the rotary encoder 25 is operated even when a voltage lower than the minimum operating voltage V is applied thereto. Herein, the rotary encoder 25 is operated when the second voltage V2 is applied thereto.

The structure of the printer 10 has been described hereinabove. Next, a sample operation of the printer 10 will be described.

Before the printer 10 is started up, the carriage 13 is in a home position, and the nozzles 39 of the inkjet head 31 are covered by the cap 17. When the main switch 53 is turned ON, the printer 10 is started up. When image data are transmitted to the controller 50, the controller 50 starts a printing operation.

First, the controller 50 causes the carriage motor 23 to operate, to move the carriage 13 from the home position on the cap 17 toward a position on the platen 16. Then, the controller 50 causes the recording head 30 to eject ink while causing the carriage 13 to move in a main scanning direction. The ejected ink lands on the recording medium 12, so that a printing operation for one scanning line is performed on the recording medium 12. Every time the carriage 13 moves in one main scanning direction, or every time the carriage 13 moves back and forth along the main scanning direction, the controller 50 causes the feed motor to operate so as to transfer the recording medium 12 by one scanning line. Then, the controller 50 causes the recording head 31 to eject ink while causing the carriage 13 to move in a main scanning direction, to perform a printing operation for the next scanning line. Thereafter, the same operation is repeated, so that an image is formed on the recording medium 12. Note that the term "image" means any image that is formed on the recording medium 12, including characters, figures, symbols, pictures, and photographs, for example. The controller 50 controls movements of the carriage 13 and ink ejection of the inkjet head 31 on the platen 16 based on the position of the carriage 13 that is detected by the rotary encoder 25.

After an image has been formed on the recording medium 12, the controller 50 causes the carriage 13 to move from a position on the platen 16 to the home position. At this time as well, the controller 50 controls movements of the carriage 13 based on the position of the carriage 13 that is detected by the rotary encoder 25. When the carriage 13 reaches the home position, the cap 17 is fitted onto the recording head 30. This completes the printing operation.

It is sometimes the case that the user inadvertently opens the front cover 11 during a printing operation. With the printer 10 according to the present preferred embodiment, when the front cover 11 is opened during a printing operation, the cover sensor 55 is turned ON, causing the circuit breaker 54 to interrupt electric power. Thus, the power supply line 62 is interrupted, and electrical power supply to the carriage motor 23 is stopped. As a result, a driving force to the carriage 13 disappears. However, because the carriage 13 and the recording head 30, which is mounted on the carriage 13 (hereinafter the carriage 13 and the recording head 30 are collectively referred to as "moving body"), are under inertial forces, the moving body does not immediately stop even when the driving force to the carriage 13 disappears, and it continues to move slightly due to the inertial forces. This means that a discrepancy arises between the position of the carriage 13 at the time when electrical power supply to the carriage motor 23 has been stopped (hereinafter referred to as an electrical power supply stop position) and the position at which the carriage 13 actually stops (hereinafter referred to as a movement stop position).

While the carriage 13 is in motion, the controller 50 continues to control ink ejection of the recording head 30, but when the carriage 13 stops, the controller 50 stops controlling of the ink ejection of the recording head 30. As a result, when the carriage 13 stops, the recording head 30 stops an ink ejection operation. The carriage 13 and the recording head 30 stand by at the movement stop position of the carriage 13.

On the other hand, even when the cover sensor 55 is turned ON, electrical power supply to the rotary encoder 25 is continued. The controller 50 is able to receive signals from the rotary encoder 25 and detect the position of the carriage 13 even during the period in which the carriage 13 continues to move due to the inertial forces. The controller 50 is able to detect the driving stop position of the carriage 13.

When the user closes the front cover 11, the cover sensor 55 is turned OFF. Then, the circuit breaker 54 is closed, and electrical power supply to the carriage motor 23 is restarted. The carriage motor 23 is operated again, and the carriage 13 restarts moving from the movement stop position. In association with the restarting of movement of the carriage 13, the recording head 30 restarts the ink ejection operation.

More specifically, the controller 50 acquires the position of the carriage 13 again from the rotary encoder 25 when the front cover 11 is closed, and performs matching between the position managed inside the controller 50 and the detected position. Thereafter, the controller 50 restarts controlling of operation of the carriage motor 23 and controlling of the ink ejection operation of the recording head 30. Because the controller 50 is able to accurately identify the movement stop position of the carriage 13, the recording head 30 is able to restart the ink ejection operation from the position at which the recording head 30 has stopped the ink ejection operation. Therefore, no discrepancy arises between the position at which the recording head 30 has stopped the ink ejection operation and the position at which it restarts the ink ejection operation.

Thereafter, the controller 50 allows the printer 10 to execute remaining printing based on the accurate positions of the carriage 13 detected by the rotary encoder 25. After completion of formation of the image on the recording medium 12, the controller 50 causes the carriage 13 to move from a position on the platen 16 to the home position, based on the position of the carriage 13 that is detected by the rotary encoder 25, and the cap 17 is fitted onto the recording head 30.

Thus, in the printer 10 according to the present preferred embodiment, electrical power supply to the carriage motor 23 is stopped if the front cover 11 is opened during printing, and therefore, movement of the carriage 13 is automatically stopped. This prevents the user from inadvertently touching the carriage 13 in motion.

With the printer 10 according to the present preferred embodiment, electrical power supply to the rotary encoder 25 is not stopped even when the front cover 11 is opened. Therefore, the controller 50 is able to continue to detect the position of the carriage 13 even when the carriage 13 continues to move due to inertial effects after electrical power supply to the carriage motor 23 has been stopped. Even if there is a difference between the electrical power supply stop position and the movement stop position, the controller 50 is able to identify the movement stop position accurately. Then, after the front cover 11 is closed, the controller 50 is able to restart controlling of movements of the carriage 13 and ink ejection of the recording head 30 from the movement stop position. Therefore, no discrepancy arises between the position at which ink ejection has been stopped that is recognized by the controller 50 and the position at which ink ejection is to be restarted. Accordingly, it is possible to prevent ink landing positions on the recording medium 12 from being misplaced when the user closes the front cover 11 to restart printing. As a result, the quality of printing is able to be prevented from degrading. Thus, even when the front cover 11 is opened during printing, the printer 10 according to the present preferred embodiment makes it possible to restart printing in a more desirable manner than conventional printers, by closing the front cover 11 thereafter.

In the present preferred embodiment, the position sensor that detects the position of the carriage 13 preferably is the rotary encoder 25 provided on the carriage motor 23. However, the position sensor that detects the position of the carriage 13 is not limited to the rotary encoder 25. The position sensor may be other types of encoders coupled to the carriage motor 23. For example, it is possible to dispose a linear encoder on the print area 14B of the guide rail 14. The position sensor may also be a sensor that identifies and detects the position of the carriage 13 by elements other than the encoder, such as a camera.

However, according to the present preferred embodiment, the position of the carriage 13 is detected by the rotary encoder 25 for the carriage motor 23. As a result, it is possible to detect the position of the carriage 13 not only when the carriage 13 is engaged with the print area 14B of the guide rail 14 but also when the carriage 13 is engaged with the home position area 14A. Therefore, the controller 50 is able to accurately identify the position of the carriage 13 and accurately carry out its control operations during the period until the cap 17 is fitted onto the recording head 30 after the front cover 11 is closed and ink ejection by the recording head 30 is completed.

Second Preferred Embodiment

A printer according to a preferred embodiment of the present invention preferably includes a printing function, but it may have other functions in addition to the printing function. A printer according to a second preferred embodiment is provided with a printing function of performing printing on the recording medium 12 and a cutting function of cutting the recording medium 12. It should be noted that the term "cutting" herein is not limited to cutting of the recording medium 12 across its entire thickness, but is meant to include partial cutting of the recording medium 12 partially across its thickness. In the following description, the same elements and features as those in the first preferred embodiment are designated by the same reference numerals, and a further description thereof will be omitted.

Figure 6:
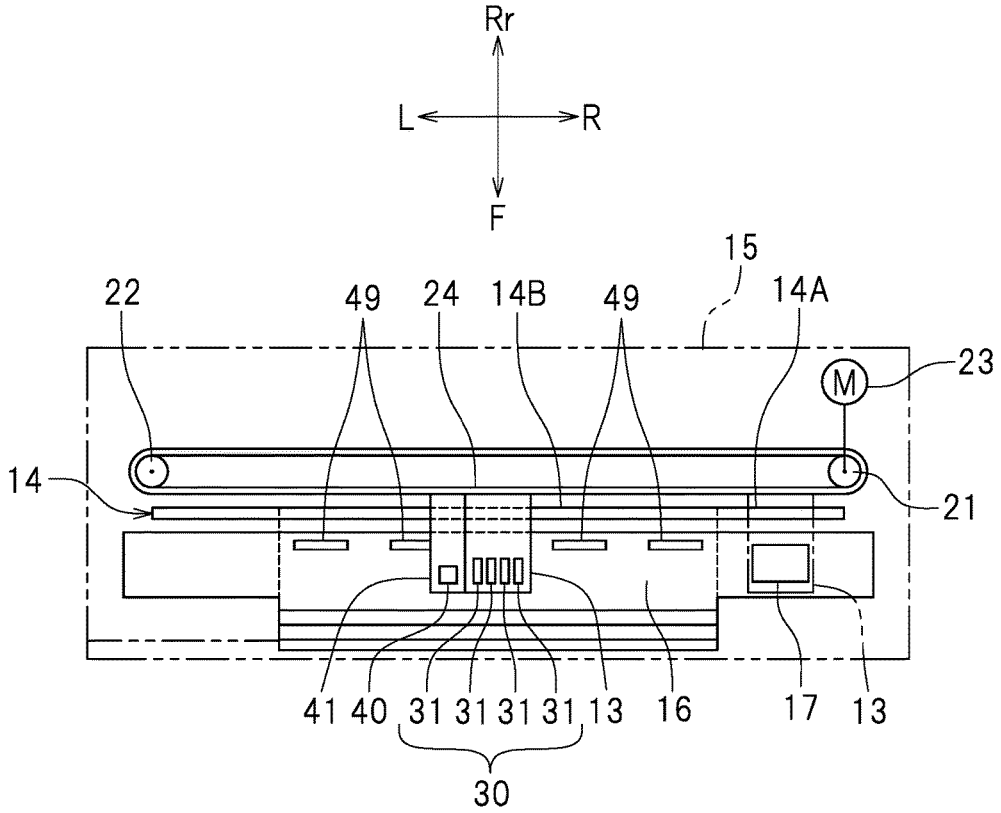
FIG. 6 is a plan view schematically illustrating main elements inside a casing of a printer according to a second preferred embodiment of the present invention.
Figure 7:
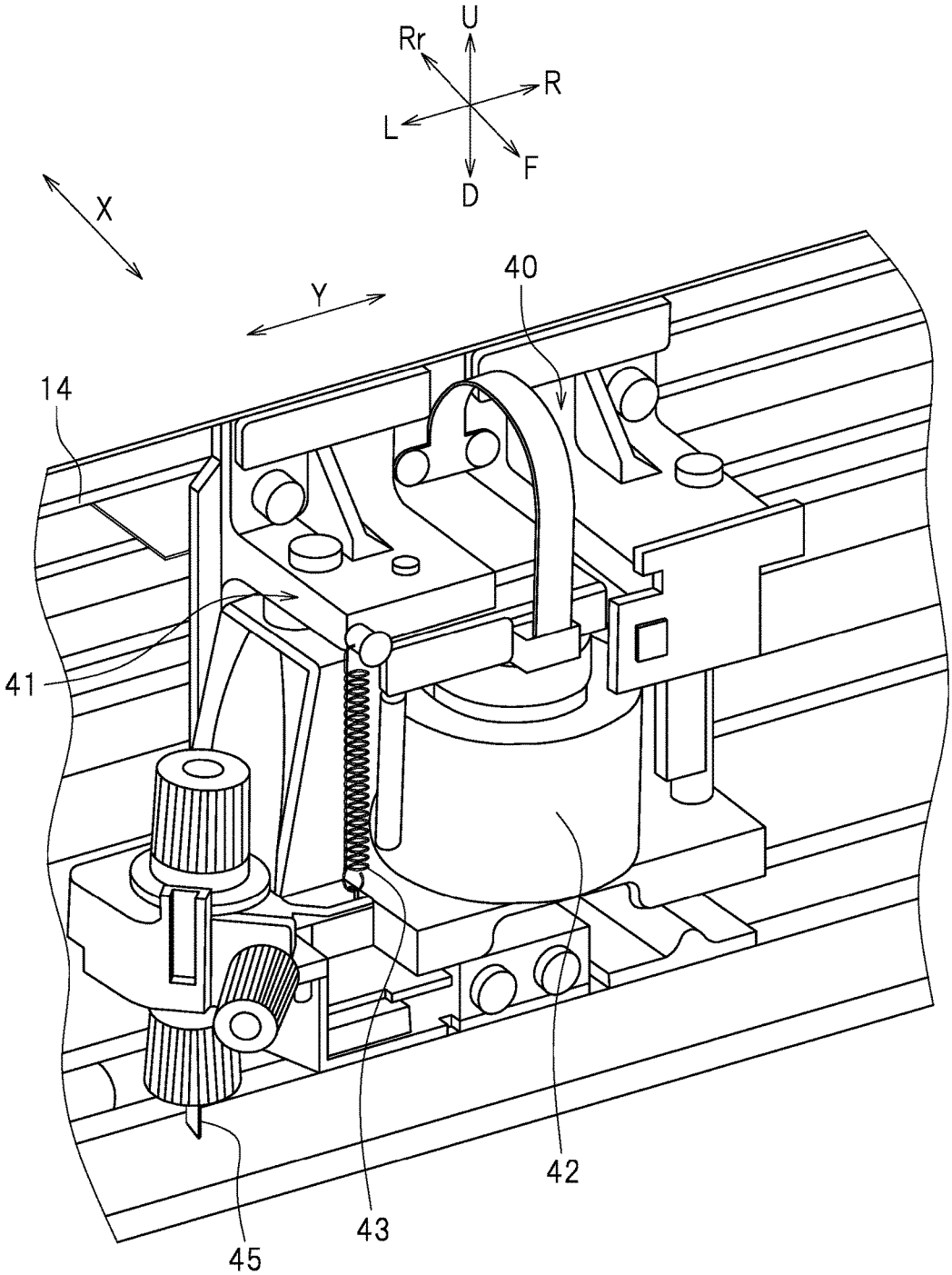
FIG. 7 is a perspective view illustrating a cutting head.
Figure 8:
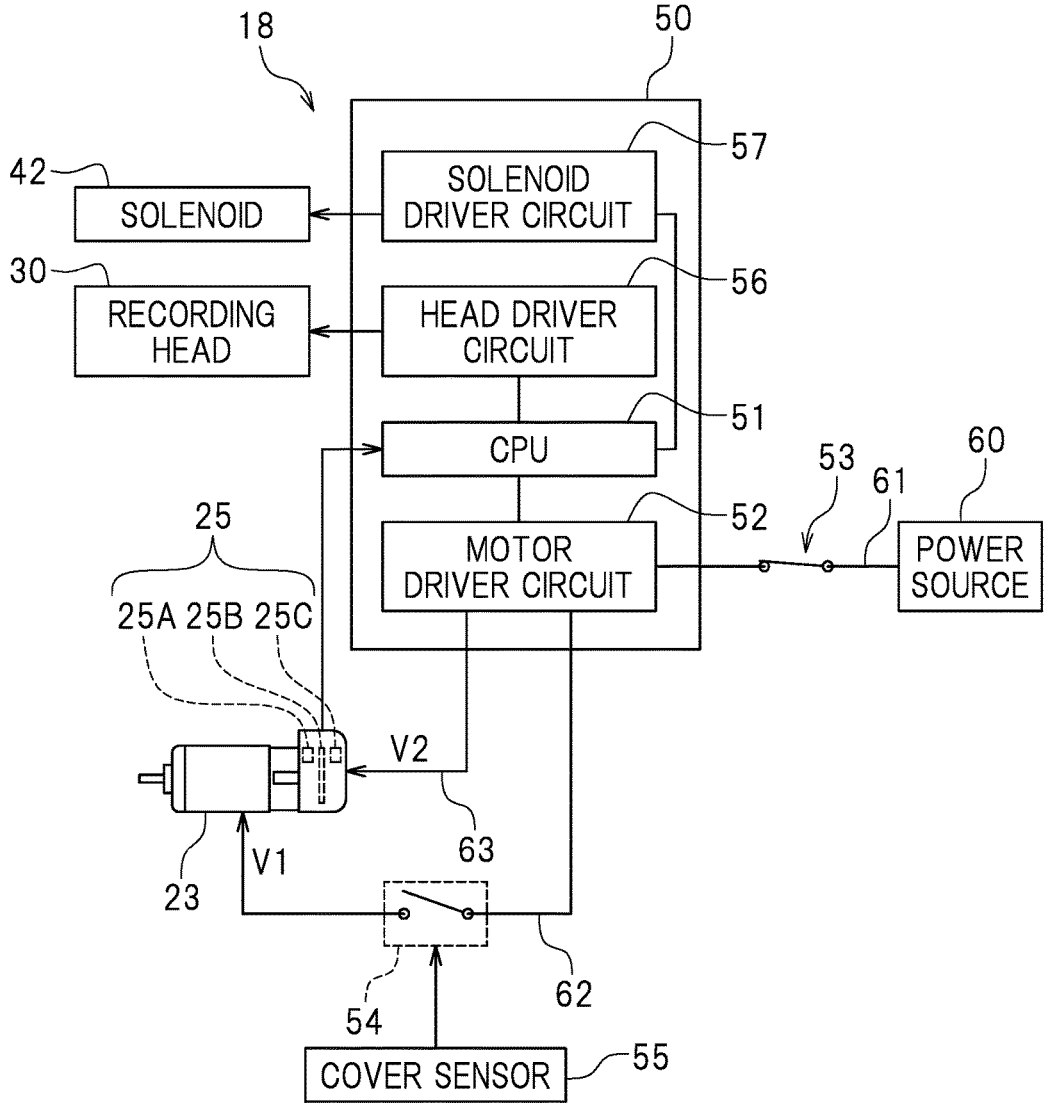
FIG. 8 is a block diagram illustrating a control system of the printer according to the second preferred embodiment of the present invention.

FIG. 6 is a plan view schematically illustrating main elements inside a casing 15 of a printer 10 according to the second preferred embodiment. As illustrated in FIG. 6, the printer 10 according to the second preferred embodiment includes a recording head 30 and a cutting head 40. The configuration of the cutting head 40 is not limited in any way. For example, as illustrated in FIG. 7, the cutting head 40 may include a cutter 45, a solenoid 42 joined to the cutter 45, and a spring 43 joined to the cutter 45. The spring 43 imparts an upward force to the cutter 45. The solenoid 42 imparts a downward force to the cutter 45 when it is turned ON. The solenoid 42 and the spring 43 together define an actuator to elevate and lower the cutter 45. As illustrated in FIG. 8, the controller 50 according to the present preferred embodiment includes a solenoid driver circuit 57 that drives the solenoid 42. The solenoid driver circuit 57 is connected to a CPU 51. The solenoid 42 is turned ON/OFF by the controller 50. More specifically, the solenoid 42 is controlled by the CPU 51 via the solenoid driver circuit 57. The cutter 45 is capable of approaching toward and moving away from the recording medium 12. Cutting of the recording medium 12 by the cutter 45 is controlled by the controller 50.

As illustrated in FIG. 6, the cutting head 40 is mounted on the carriage 41. The carriage 41 is secured to the belt 24. Therefore, as the belt 24 travels, the carriage 41 accordingly moves along the main scanning direction. The carriage 41 and the carriage 13 are coupled to each other. The carriage 41 and the carriage 13 may be either detachably coupled to each other or non-detachably coupled to each other. The carriage 41 and the carriage 13 may include a single member. In other words, the carriage 41 and the carriage 13 may be an integral component.

The rest of the configuration is the same as that in the first preferred embodiment. Therefore, the detailed description thereof will not be repeated.

In the present preferred embodiment, the carriage 41 and the carriage 13 move integrally along the main scanning direction when performing printing on the recording medium 12. The controller 50 move the carriage 41 and the carriage 13 together when the recording head 30 ejects ink. Accordingly, when the recording head 30 ejects ink, the carriage 13, the recording head 30 mounted on the carriage 13, the carriage 41, and the cutting head 40 mounted on the carriage 41 move integrally along the main scanning direction. In the present preferred embodiment, the carriage 13, the recording head 30, the carriage 41, and the cutting head 40 together define the moving body that moves along the main scanning direction.

In the present preferred embodiment, the weight of the moving body is greater than that in the first preferred embodiment. This means that the inertial force of the moving body is greater than that in the first preferred embodiment. For this reason, when the front cover 11 is opened and electrical power supply to the carriage motor 23 is stopped, it takes a longer time until the moving body stops. In the present preferred embodiment, the difference between the electrical power supply stop position and the movement stop position is greater.

Nevertheless, the printer 10 according to the present preferred embodiment continues electrical power supply to the rotary encoder 25 even when it stops electrical power supply to the carriage motor 23, so that the controller 50 is able to detect the position of the carriage 13. Therefore, even though the difference between the electrical power supply stop position and the movement stop position is greater, the controller 50 is able to identify an accurate movement stop position. For this reason, after the front cover 11 is closed, printing is able to be restarted in a more desirable manner than with conventional printers. Thus, the printer 10 including the recording head 30 and the cutting head 40 has a greater inertial force of the moving body moving along the main scanning direction, and therefore, it exhibits the advantageous effect of restarting printing in a more desirable manner than conventional printers by accurately identifying the movement stop position more noticeably.

The printer 10 according to the present preferred embodiment stops electrical power supply to the carriage motor 23 also when the front cover 11 is opened in the middle of cutting. As a result, cutting is temporarily stopped. Thereafter, when the front cover 11 is closed, electrical power supply to the carriage motor 23 is restarted, and cutting is restarted. The controller 50 can identify an accurate movement stop position not only during printing but also during cutting. Therefore, the printer 10 according to the present preferred embodiment makes it possible to restart cutting in a more desirable manner than with conventional printers and to obtain a more desirable cutting result than with conventional printers.

Although preferred embodiments of the present invention have been described hereinabove, it should be understood that the present invention is of course not limited to the foregoing preferred embodiments but may be embodied in various other forms.

The foregoing preferred embodiments preferably operate such that the circuit breaker 54 interrupts electric power when the front cover 11 is opened. However, it is also possible that the circuit breaker 54 may open also when another cover, other than the front cover 11, is opened. The other cover may also be provided with a cover sensor 55, and the circuit breaker 54 may interrupt electric power if at least one of the cover sensors 55 detects that one of the covers is opened. The number of the covers is not limited in any way.

In the foregoing preferred embodiments, the rotary encoder 25 for the carriage motor 23 is a photoelectric rotary encoder. The type of the rotary encoder 25 is, however, not limited in any way. The rotary encoder 25 may also be a magnetic rotary encoder, a laser rotary encoder, or a capacitive rotary encoder, for example.

The foregoing preferred embodiments preferably stop electrical power supply to the carriage motor 23 when the front cover 11 is opened. However, it is also possible to use a configuration in which both electrical power supply to the carriage motor 23 and electrical power supply to the feed motor are stopped when the front cover 11 is opened. It should be noted that the specific configuration to embody the just-described configuration is not limited in any way. For example, it is possible to provide a circuit breaker similar to the circuit breaker 54 on a power supply line that connects the power source 60 with the feed motor (see FIGS. 5 and 8). In this case, the controller 50 is enabled to accurately identify the movement stop position along the sub-scanning direction as well as along the main scanning direction. Therefore, when the user closes the front cover 11 to restart printing or cutting, it is possible to prevent misplacement of ink landing positions on the recording medium 12 or cutting positions of the recording medium 12 in terms of both the main scanning direction and the sub-scanning direction. This enables the printer to restart printing or cutting in an even more desirable manner than conventional printers.

Only selected preferred embodiments have been chosen to illustrate the present invention. To those skilled in the art, however, it will be apparent from the foregoing disclosure that various changes and modifications can be made herein without departing from the scope of the present invention as defined in the appended claims. Furthermore, the foregoing description of the preferred embodiments according to the present invention is provided for illustration only, and not for limiting the present invention as defined by the appended claims and their equivalents.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printer comprising:

a casing;

a guide rail disposed in the casing;

a carriage engaged with the guide rail;

a carriage motor coupled to the carriage and causing the carriage to move along the guide rail;

a recording head provided on the carriage so as to move with the carriage;

an openable/closable cover fitted to the casing;

a cover sensor detecting whether the cover is open or closed;

a position sensor detecting a position of the carriage;

a motor power supply line connecting the carriage motor with a power source;

a sensor power supply line connecting the position sensor with the power source;

a circuit breaker provided on the motor power supply line and opening if the cover sensor detects that the cover is open; and a controller communicatively connected to the position sensor, the carriage motor, and the recording head, and controlling the carriage motor and the recording head based on the position of the carriage detected by the position sensor, wherein the carriage motor is operated when a voltage equal to or higher than a predetermined minimum operating voltage is applied thereto;

the motor power supply line applies a voltage equal to or higher than the predetermined minimum operating voltage to the carriage motor; and the sensor power supply line applies a voltage lower than the predetermined minimum operating voltage to the position sensor.

2. The printer according to claim 1, wherein the position sensor includes a rotary encoder coupled to the carriage motor.

3. The printer according to claim 2, wherein:

the recording head includes an inkjet head including a plurality of nozzles that eject ink; and the printer further comprises:

a platen supporting a recording medium; and a cap disposed closer to one end of the guide rail than the platen, and covering the nozzles by being fitted onto the inkjet head; wherein:

the guide rail includes a print area positioned above the platen and a home position area positioned above the cap; and the controller causes the carriage to move from a position at which the carriage engages with the print area of the guide rail to the home position area, based on the position of the carriage that is detected by the rotary encoder.

4. The printer according to claim 1, further comprising:

a platen supporting a recording medium; wherein the cover includes a front cover at least a portion of which is positioned in front of or above the platen.

5. The printer according to claim 1, further comprising a cutting head including a cutter, the cutting head being provided on the carriage so as to move with the carriage.

6. The printer according to claim 5, wherein the controller is communicatively connected to the cutting head and controls the carriage motor and the cutting head based on the position of the carriage detected by the position sensor.

* * * * *